US012728455B2

(12) United States Patent
Yoshihara et al.

(10) Patent No.: US 12,728,455 B2
(45) Date of Patent: Sep. 8, 2026

(54) METHOD FOR PRODUCING HEAT CONDUCTIVE MEMBER AND HEAT EXCHANGER

(71) Applicant: NGK Insulators, Ltd., Nagoya-City (JP)

(72) Inventors: Makoto Yoshihara, Iwakura-City (JP); Tatsuo Kawaguchi, Mizuho-City (JP)

(73) Assignee: NGK INSULATORS, LTD., Nagoya-City (JP)

( * ) Notice: Subject to any disclaimer, the term of this patent is extended or adjusted under 35 U.S.C. 154(b) by 575 days.

(21) Appl. No.: 18/156,569

(22) Filed: Jan. 19, 2023

(65) Prior Publication Data

US 2023/0302524 A1 Sep. 28, 2023

(30) Foreign Application Priority Data

Mar. 22, 2022 (JP) ..... 2022-046045

(51) Int. Cl.
*B21D 53/06* (2006.01)
*F28F 1/40* (2006.01)
*F28F 9/00* (2006.01)

(52) U.S. Cl.
CPC ..... *B21D 53/06* (2013.01); *F28F 1/40* (2013.01); *F28F 9/005* (2013.01)

(58) Field of Classification Search
CPC ..... B21D 53/06; F02C 7/141; F28F 9/005
See application file for complete search history.

(56) References Cited

U.S. PATENT DOCUMENTS

2004/0011103 A1* 1/2004 Takahashi ..... B21D 41/00 72/84
2007/0053740 A1 3/2007 Herrmann
2009/0289399 A1* 11/2009 Suzuki ..... B60G 3/20 267/140.12
2019/0277570 A1* 9/2019 Kawaguchi ..... F28F 21/04
(Continued)

FOREIGN PATENT DOCUMENTS

CN 112484551 A 3/2021
JP S50-078952 A 6/1975
(Continued)

OTHER PUBLICATIONS

Japanese Office Action (with English translation) dated Jun. 23, 2025 (Application No. 2022-046045).
(Continued)

*Primary Examiner* — Gordon A Jones
(74) *Attorney, Agent, or Firm* — Muncy, Geissler, Olds & Lowe, P.C.

(57) ABSTRACT

A method for producing a heat conductive member includes the steps of: preparing a hollow type heat recovery member having: an inner peripheral surface and an outer peripheral surface in an axial direction; and a first end face and a second end face in a direction orthogonal to the axial direction; inserting an inner cylindrical member into a hollow portion formed in an inner region of the inner peripheral surface; and subjecting the inner cylindrical member to plastic working, and fitting at least a part of the inner cylindrical member to at least a part of one or more selected from the inner peripheral surface, the first end face, and the second end face of the heat recovery member.

8 Claims, 5 Drawing Sheets

(56) References Cited

U.S. PATENT DOCUMENTS

| | | | |
|---|---|---|---|
| 2021/0080187 | A1 | 3/2021 | Fumoto et al. |
| 2022/0390181 | A1 | 12/2022 | Akahani et al. |

FOREIGN PATENT DOCUMENTS

| | | | |
|---|---|---|---|
| JP | 2000-202536 | A | 7/2000 |
| JP | 2010-046697 | A | 3/2010 |
| JP | 2015-102051 | A | 6/2015 |
| JP | 2020-059044 | A | 4/2020 |
| WO | 2021/171670 | A1 | 9/2021 |

OTHER PUBLICATIONS

Chinese Office Action (Application No. 202310167461.7) dated Oct. 31, 2025 (with English translation) (19 pages).

* cited by examiner

100

100

METHOD FOR PRODUCING HEAT CONDUCTIVE MEMBER AND HEAT EXCHANGER

CROSS REFERENCE TO RELATED APPLICATIONS

The present invention claims the benefit of priority to Japanese Patent Application No 2022-046045 filed on Mar. 22, 2022 with the Japanese Patent Office, the entire contents of which are incorporated herein by reference in its entirety.

FIELD OF THE INVENTION

The present invention relates to a method for producing a heat conductive member and a heat exchanger.

BACKGROUND OF THE INVENTION

Recently, there is a need for improvement of fuel economy of motor vehicles. In particular, a system is expected that worms up a coolant, engine oil and an automatic transmission fluid (ATF: Automatic Transmission Fluid) at an early stage to reduce friction losses, in order to prevent deterioration of fuel economy at the time when an engine is cold, such as when the engine is started. Further, a system is expected that heats an exhaust gas purifying catalyst in order to activate the catalyst at an early stage.

As one of such systems, for example, there is a heat exchanger. The heat exchanger is a device that exchanges heat between a first fluid and a second fluid by allowing the first fluid to flow inside and the second fluid to flow outside. In such a heat exchanger, for example, the heat can be effectively utilized by exchanging the heat from the first fluid having a higher temperature (for example, an exhaust gas) to the second fluid having a lower temperature (for example, cooling water).

A heat exchanger for recovering heat from a high-temperature gas such as an exhaust gas from a motor vehicle is proposed, which includes: a hollow type heat recovery member (pillar shaped honeycomb structure); a first outer cylindrical member fitted to a surface of an outer peripheral wall of the heat recovery member; an inner cylindrical member fitted to an surface of an inner peripheral wall of the heat recovery member; an upstream cylindrical member having a portion arranged on a radially inner side of the inner cylindrical member at a distance so as to form a flow path for a first fluid; a cylindrical connecting member that connects an upstream end portion of the first outer cylindrical member to an upstream side of the upstream cylindrical member so as to form the flow path for the first fluid; and a downstream cylindrical member connected to a downstream end portion of the outer cylindrical member and having a portion arranged on a radially outer side of the inner cylindrical member at a distance so as to form the flow path for the first fluid (Patent Literature 1). The heat exchanger includes at least one of two sealing members arranged on the outer peripheral surface of the inner cylindrical member and two sealing portions provided on the outer peripheral surface of the inner cylindrical member, wherein each of surfaces of the outer peripheral walls on the first end face side and the second end face side is fitted through at least one of the two sealing members and the two sealing portions. Thus, the provision of the sealing members and the sealing portions can lead to suppression of displacement of the heat recovery member due to the inflow of the first fluid or thermal expansion. It can also lead to suppression of deterioration in heat recovery performance due to the inflow of the first fluid.

PRIOR ART

Patent Literature

[Patent Literature 1] WO 2021/171670 A1

SUMMARY OF THE INVENTION

The present invention relates to a method for producing a heat conductive member, the method comprising the steps of:

- preparing a hollow type heat recovery member having: an inner peripheral surface and an outer peripheral surface in an axial direction; and a first end face and a second end face in a direction orthogonal to the axial direction;
- inserting an inner cylindrical member into a hollow portion formed in an inner region of the inner peripheral surface; and
- subjecting the inner cylindrical member to plastic working, and fitting at least a part of the inner cylindrical member to at least a part of one or more selected from the inner peripheral surface, the first end face, and the second end face of the heat recovery member.

Also, the present invention relates to a heat exchanger, comprising:

- a hollow type heat recovery member having: an inner peripheral surface and an outer peripheral surface in an axial direction; and a first end face and a second end face in a direction perpendicular to the axial direction;
- a first outer cylindrical member fitted to the outer peripheral surface of the heat recovery member;
- an inner cylindrical member fitted so as to be brought into surface contact with a portion other than both end portions in the axial direction of the outer peripheral surface of the heat recovery member;
- an upstream cylindrical member having a portion arranged on a radially inner side of the inner cylindrical member at a distance so as to form a flow path for a first fluid;
- a cylindrical connecting member for connecting an upstream end portion of the first outer cylindrical member to an upstream side of the upstream cylindrical member so as to form the flow path for the first fluid; and
- a downstream cylindrical member having a portion, the portion being connected to a downstream end portion of the first outer cylindrical member and being arranged on a radially outer side of the inner cylindrical member at a distance so as to form the flow path for the first fluid.

DETAILED DESCRIPTION OF THE INVENTION

Figure 1:
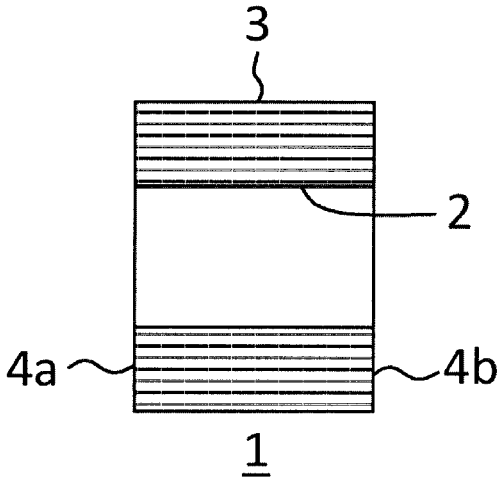
FIG. 1 is a cross-sectional view of a hollow type heat recovery member, which is parallel to an axial direction.

Although the sealing members described in Patent Literature 1 need to be welded to the outer peripheral surface of the inner cylindrical member, the welding may be difficult. Further, it is difficult to position the sealing members with respect to the outer peripheral surface of the inner cylindrical member, and if the positioning is not appropriate, a gap is generated between the heat recovery member and the sealing member.

Also, the sealing portions as described in Patent Literature 1 need to be formed at the inner cylindrical member in advance. Therefore, it is difficult to position the sealing portions of the inner cylindrical member, and if the positioning is not appropriate, a gap is generated between the heat recovery member and the sealing portion.

The present invention has been made to solve the problems as described above. An object of the present invention is to provide a method for producing a heat conductive member, which can improve a seal efficiency between a heat recovery member and an inner cylindrical member.

Also, an object of the present invention is to provide a heat exchanger having improved a seal efficiency between a heat recovery member and an inner cylindrical member.

As a result of intensive studies to solve the above problems, the present inventors have found that after inserting the inner cylindrical member into the hollow portion of the heat recovery member, a certain position of the inner cylindrical member is subjected to plastic working, whereby the positioning of the sealing portions becomes unnecessary and the sealing efficiency between the heat recovery member and the inner cylindrical member can be improved, and they have completed the present invention.

According to the present invention, it is possible to provide a method for producing a heat conductive member, which can improve a seal efficiency between a heat recovery member and an inner cylindrical member.

Also, according to the present invention, it is possible to provide a heat exchanger having improved a seal efficiency between a heat recovery member and an inner cylindrical member.

Hereinafter, embodiments of the present invention will be specifically described with reference to the drawings as needed. It is to understand that the present invention is not limited to the following embodiments, and those which appropriately added changes, improvements and the like to the following embodiments based on knowledge of a person skilled in the art without departing from the spirit of the present invention fall within the scope of the present invention.

(1) Method for Producing Heat Conductive Member

A method for producing a heat conductive member according to an embodiment of the present invention includes: a preparing step of a heat recovery member; an inserting step of an inner cylindrical member; and a fitting step.

The details of each step are described below.

<Preparing Step of Heat Recovery Member>

The preparing step of the heat recovery member is a step of preparing a hollow type heat recovery member having: an inner peripheral surface and an outer peripheral surface in an axial direction (a flow path direction of a first fluid); and a first end face and a second end face in a direction orthogonal to the axial direction.

Here, referring to FIG. 1, it shows a cross-sectional view of a hollow type heat recovery member (which may, hereinafter, be abbreviated as a "heat recovery member"), which is parallel to the axial direction. As shown in FIG. 1, a heat recovery member 1 includes: an inner peripheral surface 2 and an outer peripheral surface 3 in the axial direction; and a first end face 4*a* and a second end face 4*b* in a direction orthogonal to the axial direction.

The heat recovery member is not particularly limited as long as it has the structure as described above, but it may preferably be a hollow type pillar shaped honeycomb structure.

Figure 2:
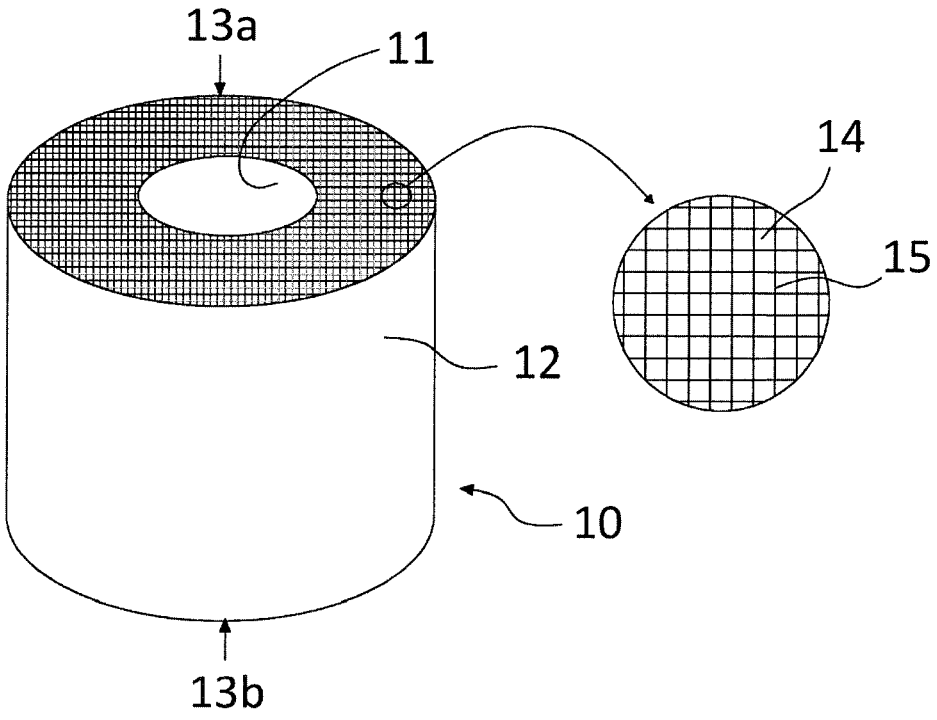
FIG. 2 is a perspective view of a hollow type pillar shaped honeycomb structure.
Figure 3:
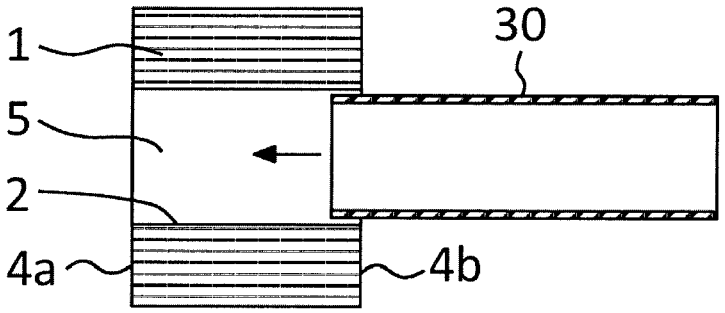
FIG. 3 is a view for explaining an inserting step of an inner cylindrical member.

Here, referring to FIG. 2, it shows a perspective view of a hollow type pillar shaped honeycomb structure. As shown in FIG. 3. a hollow pillar shaped honeycomb structure 10 includes an inner peripheral wall 11, an outer peripheral wall 12, and a partition wall 15 which is disposed between the inner peripheral wall 11 and the outer peripheral wall 12, and which defines a plurality of cells 14 extending from a first end face 13*a* to a second end face 13*b* to form flow paths for a first fluid.

As used herein, the "hollow pillar shaped honeycomb structure 10" refers to a pillar shaped honeycomb structure 10 having a hollow region at a central portion in a cross section of the hollow pillar shaped honeycomb structure 10, which is perpendicular to a flow direction of the first fluid.

A shape (outer shape) of the hollow pillar shaped honeycomb structure 10 is not particularly limited, but it may be, for example, a circular pillar shape, an elliptical pillar shape, a quadrangular pillar shape, or other polygonal pillar shape.

Also, a shape of the hollow region in the hollow pillar shaped honeycomb structure 10 is not particularly limited, but it may be, for example, a circular pillar shape, an elliptical pillar shape, a quadrangular pillar shape, or other polygonal pillar shape.

It should be note that the shape of the hollow pillar shaped honeycomb structure 10 and the shape of the hollow region may be the same as or different from each other. However, they are preferably the same as each other, in terms of resistance to external impact, thermal stress, and the like.

Each cell 14 may have any shape, including, but not particularly limited to, circular, elliptical, triangular, quadrangular, hexagonal and other polygonal shapes in a cross section in a direction perpendicular to a flow path direction of the first fluid. Also, the cells 14 are radially provided in a cross section in a direction perpendicular to the flow path direction of the first fluid. Such a structure can allow heat of the first fluid flowing through the cells 14 to be efficiently transmitted to the outside of the hollow pillar shaped honeycomb structure 10.

A thickness of the partition wall 15 may preferably be from 0.1 mm to 1 mm, and more preferably from 0.2 mm to 0.6 mm, although not particularly limited thereto. The thickness of the partition wall 15 of 0.1 mm or more can provide the hollow pillar shaped honeycomb structure 10 with a sufficient mechanical strength. Further, the thickness of the partition wall 5 of 1.0 mm or less can suppress problems that the pressure loss is increased due to a decrease in an opening area and the heat recovery efficiency is decreased due to a decrease in a contact area with the first fluid.

Each of the inner peripheral wall 11 and the outer peripheral wall 12 preferably has a thickness larger than that of the partition wall 15, although not particularly limited thereto. Such a structure can lead to increased strength of the inner peripheral wall 11 and the outer peripheral wall 12 which would otherwise tend to generate breakage (e.g., cracking, chinking, and the like) by external impact, thermal stress due to a temperature difference between the first fluid and the second fluid, and the like.

In addition, the thicknesses of the inner peripheral wall 11 and the outer peripheral wall 12 are not particularly limited, and they may be adjusted as needed according to applications and the like. For example, the thickness of each of the inner peripheral wall 11 and the outer peripheral wall 12 is preferably from 0.3 mm to 10 mm, and more preferably from 0.5 mm to 5 mm, and even more preferably from 1 mm to 3 mm, when using the heat exchange 100 for general heat exchange applications. Moreover, when using the heat exchanger 100 for heat storage applications, the thickness of the outer peripheral wall 12 is preferably 10 mm or more, in order to increase a heat capacity of the outer peripheral wall 12.

The partition wall 15, the inner peripheral wall 11 and the outer peripheral wall 12 preferably contain ceramics as a main component. The phrase "contain ceramics as a main component" means that a ratio of a mass of ceramics to the mass of the total component is 50% by mass or more.

Each of the partition wall 15, the inner peripheral wall 11 and the outer peripheral wall 12 preferably has a porosity of 10% or less, and more preferably 5% or less, and even more preferably 3% or less, although not particularly limited thereto. Further, the porosity of the partition wall 15, the inner peripheral wall 11 and the outer peripheral wall 12 may be 0%. The porosity of the partition wall 15, the inner peripheral wall 11 and the outer peripheral wall 12 of 10% or less can lead to improvement of thermal conductivity.

The partition wall 15, the inner peripheral wall 11 and the outer peripheral wall 12 preferably contain SiC (silicon carbide) having high thermal conductivity as a main component. Examples of such a material includes Si-impregnated SiC, (Si+Al) impregnated SiC, a metal composite SiC, recrystallized SiC, $Si_3N_4$, SiC, and the like. Among them, Si-impregnated SiC and (Si+Al) impregnated SiC are preferably used because they can allow production at lower cost and have high thermal conductivity.

A cell density (that is, the number of cells 14 per unit area) in the cross section of the hollow pillar shaped honeycomb structure 10 perpendicular to the axial direction is preferably in a range of from 4 to 320 cells/cm$^2$, although not particularly limited thereto. The cell density of 4 cells/cm$^2$ or more can sufficiently ensure the strength of the partition walls 15, hence the strength of the hollow pillar shaped honeycomb structure 10 itself and effective GSA (geometrical surface area). Further, the cell density of 320 cells/cm$^2$ or less can allow prevention of an increase in a pressure loss when the first fluid flows.

The hollow pillar shaped honeycomb structure 10 preferably has an isostatic strength of more than 100 MPa, and more preferably 150 MPa or more, and still more preferably 200 MPa or more, although not particularly limited thereto. The isostatic strength of the hollow pillar shaped honeycomb structure 10 of 100 MPa or more can lead to the hollow pillar shaped honeycomb structure 10 having improved durability. The isostatic strength of the hollow pillar shaped honeycomb structure 10 can be measured according to the method for measuring isostatic strength as defied in the JASO standard M505-87 which is a motor vehicle standard issued by Society of Automotive Engineers of Japan, Inc.

A diameter (an outer diameter) of the outer peripheral wall 12 in the cross section in direction perpendicular to the axial direction may preferably be from 20 mm to 200 mm, and more preferably from 30 mm to 100 mm, although not particularly limited thereto. Such a diameter can allow improvement of heat recovery efficiency. When the shape of the outer peripheral wall 12 is not circular, the diameter of the largest inscribed circle that is inscribed in the cross-sectional shape of the outer peripheral wall 12 is defined as the diameter of the outer peripheral wall 12.

Further, a diameter of the inner peripheral wall 11 in the cross section in the direction perpendicular to the axial direction may preferably be from 1 mm to 50 mm, and more preferably from 2 mm to 30 mm, although not particularly limited thereto. When the cross-sectional shape of the inner peripheral wall 11 is not circular, the diameter of the largest inscribed circle that is inscribed in the cross-sectional shape of the inner peripheral wall 11 is defined as the diameter of the inner peripheral wall 11.

The hollow pillar shaped honeycomb structure 10 preferably has a thermal conductivity of 50 W/(m·K) or more at 25° C., and more preferably from 100 to 300 W/(m·K), and even more preferably from 120 to 300 W/(m K), although not particularly limited thereto. The thermal conductivity of the hollow pillar shaped honeycomb structure 10 in such a range can lead to an improved thermal conductivity and can allow the heat inside the hollow pillar shaped honeycomb structure 10 to be efficiently transmitted to the outside. It should be noted that the value of thermal conductivity is a value measured according to the laser flash method (JIS R 1611-1997).

In the case where an exhaust gas as the first fluid flows through the cells 14 in the hollow pillar shaped honeycomb structure 10, a catalyst may be supported on the partition wall 15 of the pillar shaped honeycomb structure 10. The supporting of the catalyst on the partition wall 15 can allow CO, NOx, HC and the like in the exhaust gas to be converted into harmless substances through catalytic reaction, and can also allow reaction heat generated during the catalytic reaction to be utilized for heat exchange. Preferable catalysts include those containing at least one element selected from the group consisting of noble metals (platinum, rhodium, palladium, ruthenium, indium, silver and gold), aluminum, nickel, zirconium, titanium, cerium, cobalt, manganese, zinc, copper, tin, iron, niobium, magnesium, lanthanum, samarium, bismuth, and barium. Any of the above-listed elements may be contained as a metal simple substance, a metal oxide, or other metal compound.

A supported amount of the catalyst (catalyst metal+support) may preferably be from 10 to 400 g/L, although not particularly limited thereto. Further, when using the catalyst containing the noble metal(s), the supported amount may preferably be from 0.1 to 5 g/L, although not particularly limited thereto. The supported amount of the catalyst (catalyst metal+support) of 10 g/L or more can easily achieve catalysis. Also, the supported amount of the catalyst (catalyst metal+support) of 400 g/L or less can allow suppression of both an increase in a pressure loss and an increase in a manufacturing cost. The support refers to a carrier on which a catalyst metal is supported. Examples of the supports include those containing at least one selected from the group consisting of alumina, ceria and zirconia.

The hollow type pillar shaped honeycomb structure 10 can be produced in accordance with a method known in the art. For example, the hollow type pillar shaped honeycomb structure 10 can be produced in accordance with the method described below.

First, a green body containing ceramic powder is extruded into a desired shape to prepare a honeycomb formed body. At this time, the shape and density of the cells 14, and shapes and thicknesses of the partition wall 15, the inner peripheral wall 11 and the outer peripheral wall 12, and the like, can be controlled by selecting dies and jigs in appropriate forms. The material of the honeycomb formed body that can be used herein includes the ceramics as described above. For example, when producing a honeycomb formed body containing the Si-impregnated SiC composite as a main component, a binder and water and/or an organic solvent are added to a predetermined amount of SiC powder, and the resulting mixture is kneaded to form a green body, which can be then formed into a honeycomb formed body having a desired shape. The resulting honeycomb formed body can be then dried, and the honeycomb formed body can be impregnated with metal Si and fired in an inert gas under reduced pressure or vacuum to obtain the hollow pillar shaped honeycomb structure 10 having the cells 14 defined by the partition wall 15.

<Inserting Step of Inner Cylindrical Member>

The inserting step of the inner cylindrical member is a step of inserting the inner cylindrical member into a hollow portion formed in an inner region of the inner peripheral surface of the heat recovery member.

Here, a view for explaining the inserting step of the inner cylindrical member is shown in FIG. 3. FIG. 3 is a cross-sectional view of the hollow type heat recovery member, which is parallel to the axial direction.

As shown in FIG. 3, the inner cylindrical member 30 is inserted from the second end face 4*b* side of the heat recovery member 1 into a hollow portion 5 formed in the inner region of the inner peripheral surface 2 and arranged at a predetermined position. Although the inner cylindrical member 30 is inserted from the second end face 4*b* side of the heat recovery member 1 in FIG. 3, the inner cylindrical member 30 may be inserted from the first end face 4*a* side of the heat recovery member 1.

The inner cylindrical member 30 preferably has a difference between a diameter of a portion inserted into the hollow portion 5 of the heat recovery member 1 and a diameter of the hollow portion 5 of the heat recovery member 1 of 1 mm to 10 mm. The control of such a difference between the diameters can facilitate the insertion of the inner cylindrical member 30 into the hollow portion 5 of the heat recovery member 1 and plastic working as described below.

The inner cylindrical member 30 may have a buffering material previously arranged on the outer peripheral surface of the inner cylindrical member 30 before the inserting step of the inner cylindrical member 30. By previously arranging the buffering material on the outer peripheral surface of the inner cylindrical member 30, the buffering material can be arranged between the heat recovery member 1 and the inner cylindrical member 30 in the fitting step. Examples of the buffering material include, but not limited to, graphite sheets and heat insulating mats.

The inner cylindrical member 30 is not particularly limited, and it may have a uniform diameter in the axial direction, or may have a decreased and/or increased diameter in the axial direction.

It is preferable that the axial direction of the inner cylindrical member 30 coincides with that of the heat recovery member 1 and the central axis of the inner cylindrical member 30 coincides with that of the heat recovery member 1.

Although the material of the inner cylindrical member 30 is not particularly limited, it is preferably a metal from the viewpoint of manufacturability. Further, the inner cylindrical member 30 made of a metal is suitable in that it can be easily welded to other members as described later. Examples of the material of the inner cylindrical member 30 that can be used herein stainless steel, titanium alloys, copper alloys, aluminum alloys, brass, and the like. Among them, the stainless steel is preferable because of its high durability and reliability and lower cost.

Although the thickness of the inner cylindrical member 30 is not particularly limited, it is preferably 0.1 mm or more, and more preferably 0.3 mm or more, and even more preferably 0.5 mm or more. The thickness of the inner cylindrical member 30 of 0.1 mm or more can ensure durability and reliability. Moreover, the thickness of the inner cylindrical member 30 is preferably 10 mm or less, and more preferably 5 mm or less, and even more preferably 3 mm or less. The thickness of the inner cylindrical member 30 of 10 mm or less can allow thermal resistance to be reduced to increase thermal conductivity.

<Fitting Step>

The fitting step is a step of subjecting the inner cylindrical member 30 to plastic working, and fitting at least a part of the inner cylindrical member 30 to at least a part of one or more selected from the inner peripheral surface 2, the first end face 4*a* and the second end face 4*b* of the heat recovery member 1.

As used herein, the term "plastic working" means a process of applying a force to the material to be processed (the inner cylindrical member 30) to deform it into a predetermined shape.

Examples of the plastic working include, but not particularly limited to, bulging (stretching), spatula drawing, and press working.

Figure 4:
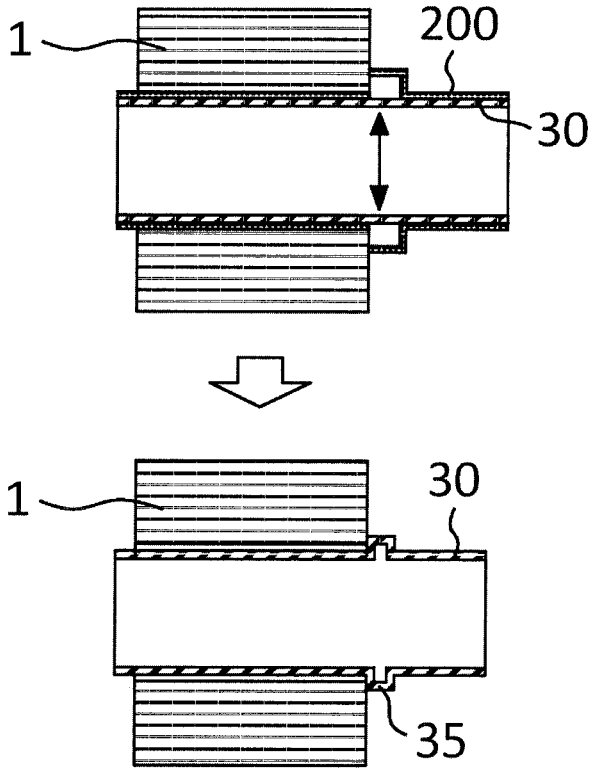
FIG. 4 is a view for explaining a fitting step.

Here, a view for explaining the fitting step is shown in FIG. 4. FIG. 4 is a cross-sectional view of a hollow type heat recovery member, which is parallel to the axial direction. In addition, FIG. 4 shows a case where the bulging is used as the plastic working is shown as an example.

The bulging is carried out by placing a mold 200 on the outer peripheral surface of the inner cylindrical member 30 other than a portion to be bulged (a periphery of the portion corresponding to the second end face 4*b* of the heat recovery member 1 in FIG. 4), and then axially compressing both shafts of the inner cylindrical member 30 while filling the interior of the inner cylindrical member 30 with a liquid at high pressure. After the bulging, the mold 200 can be removed to obtain the inner cylindrical member 30 in which the heat recovery member 1 is fitted to the predetermined portion by the bulging.

It should be noted that although FIG. 4 shows the inner cylindrical member 30 fitted to the second end face 4*b* of the heat recovery member 1 as an example, the inner cylindrical member 30 fitted to each portion of the heat recovery member 1 can be obtained by changing the portion to be bulged.

In the fitting step, after inserting the inner cylindrical member 30 into the hollow portion 5 of the heat recovery member 1, the inner cylindrical member 30 is deformed by plastic working such as the bulging, so that sealing portions 35 that are along with the shape of the heat recovery member 1 can be formed. Therefore, there is no need to previously form the positioned sealing portions on the inner cylindrical member 30 or weld the sealing members to the inner cylindrical member 30, as in the conventional art, so that a seal efficiency between the heat recovery member 1 and the inner cylindrical member 30 can be improved.

The plastic working such as the bulging can be performed so that the inner cylindrical member 30 is brought into surface contact with the first end face 4*a* and/or the second end face 4*b* of the heat recovery member 1. In addition, when the buffering material is previously arranged on the outer peripheral surface of the inner cylindrical member 30, the plastic working is performed so that the inner cylindrical member 30 is brought into indirect surface contact with the first end face 4*a* and/or the second end face 4*b* of the heat recovery member 1 via the buffering material.

Figure 5:
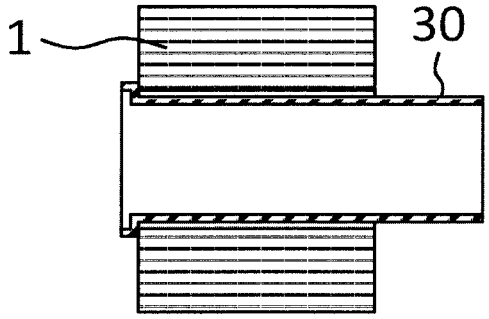
FIG. 5 is a cross-sectional view of a heat conductive member having an inner cylindrical member subjected to bulging (plastic working) so as to be brought into surface contact with a first end face of a heat recovery member.

FIG. 4 shows an example of the inner cylindrical member 30 subjected to the bulging so as to be brought into surface contact with the second end face 4*b* of the heat recovery member 1 (in particular, the outer peripheral portion of the second end face 4*b*). Further, FIG. 5 shows an example of the inner cylindrical member 30 subjected to the bulging so as to be brought into surface contact with the first end face 4*a* of the heat recovery member 1 (in particular, the outer peripheral portion of the first end face 4*a*) (which is a cross-sectional view parallel to the axial direction). Although not shown, the inner cylindrical member 30 may be subjected to the bulging so as to be brought into surface contact with both the first end face 4*a* and the second end face 4*b* of the heat recovery member 1. By performing the bulging so as to be brought into surface contact with these portions, the seal efficiency between the heat recovery member 1 and the inner cylindrical member 30 can be stably improved.

The plastic working such as the bulging can be performed so that the inner cylindrical member 30 is brought into surface contact with a portion other than end portions in the axial direction of the inner peripheral surface 2 of the heat recovery member 1. When the buffering material is previously arranged on the outer peripheral surface of the inner cylindrical member 30, the plastic working can be performed so that the inner cylindrical member 30 is brought into indirect surface contact with the portion other than the end portions in the axial direction of the inner peripheral surface 2 of the heat recovery member 1 via the buffering material.

Figure 6:
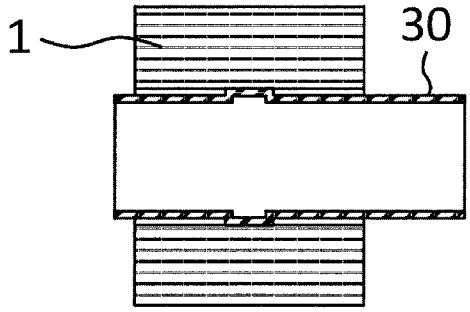
FIG. 6 is a cross-sectional view of a heat conductive member having an inner cylindrical member subjected to bulging (plastic working) so as to be brought into surface contact with an axially central portion of an inner peripheral surface of a heat recovery member.

FIG. 6 is an example of the inner cylindrical member 30 subjected to the bulging so as to be brought into surface contact with the axially central portion of the inner peripheral surface 2 of the heat recovery member 1 (which is cross-sectional view parallel to the axial direction of the heat recovery member 1). By performing the bulging so as be brought into surface contact with the portion, the seal efficiency between the heat recovery member 1 and the inner cylindrical member 30 can be stably improved.

The plastic working such as the bulging can be performed so that the inner cylindrical member 30 is brought into surface contact with the entire inner peripheral surface 2 of the heat recovery member 1. When the buffering material is previously arranged on the outer peripheral surface of the inner cylindrical member 30, the plastic working can be performed so that the inner cylindrical member 30 is brought into indirect surface contact with the entire inner peripheral surface 2 of the heat recovery member 1 via the buffering material.

Figure 7:
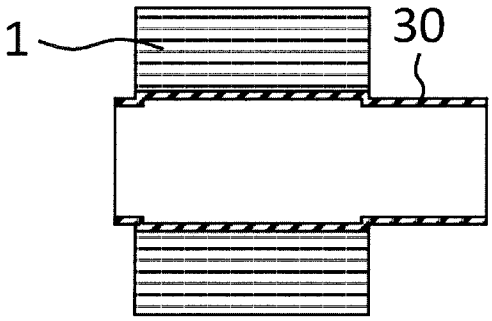
FIG. 7 is a cross-sectional view of a heat conductive member having an inner cylindrical member subjected to bulging (plastic working) so as to be brought into surface contact with the entire inner peripheral surface of a heat recovery member.

FIG. 7 is an example of the inner cylindrical member 30 subjected to the bulging so as to be brought into surface contact with the entire inner peripheral surface 2 of the heat recovery member 1 (which is a cross-sectional view parallel to the axial direction of the heat recovery member 1). By performing the bulging so as to be brought into surface contact with that portion, the seal efficiency between the heat recovery member 1 and the inner cylindrical member 30 can be stably improved.

The plastic working such as bulging can be performed so that the inner cylindrical member 30 is brought into surface contact with the inner peripheral surface 2 of the heat recovery member 1 at two or more positions. In addition, when the buffering material is previously arranged on the outer peripheral surface of the inner cylindrical member 30, the plastic working can be performed so that the inner cylindrical member 30 is brough into indirect surface contact with the inner peripheral surface 2 of the heat recovery member 1 at two or more positions via the buffering material.

Figure 8:
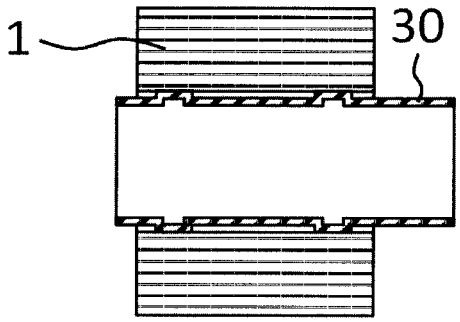
FIG. 8 is a cross-sectional view of a heat conductive member having an inner cylindrical member subjected to bulging (plastic working) so as to be brought into surface contact with an inner peripheral surface of a heat recovery member at two points.

FIG. 8 is an example of the inner cylindrical member 30 subjected to the bulging so as to be brought into surface contact with the inner peripheral surface 2 of the heat recovery member 1 at two positions (which is a cross-sectional view parallel to the axial direction of the heat recovery member 1). The upper limit of the number of contact positions is not particularly limited, but it may be appropriately set according to the length of the heat recovery member 1 in the axial direction, and for examples, the number of contact positions is five. By performing the bulging so as to be brought into surface contact with that portion, the seal efficiency between the heat recovery member 1 and the inner cylindrical member 30 can be stably improved.

Figure 9:
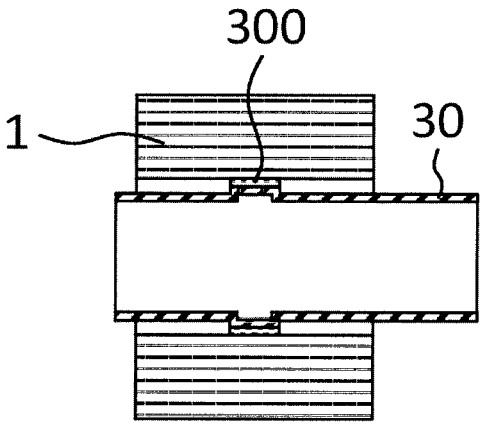
FIG. 9 is a cross-sectional view of a heat conductive member having a buffering material between an inner cylindrical member subjected to bulging (plastic working) and a heat recovery member.

FIG. 9 shows an example of the inner cylindrical member 30 subjected to the bulging after previously arranging a buffering material 300 on the outer peripheral surface of the inner cylindrical member 30 and inserting the inner cylindrical member into the hollow portion 5 of the heat recovery member 1 (which is a cross-sectional view parallel to the axial direction of the heat recovery member 1). By previously arranging the buffering material 300 on the outer peripheral surface of the inner cylindrical member 30, the seal efficiency can be stably improved while interposing the buffering material 300 between the heat recovery member 1 and the inner cylindrical member 30.

(2) Heat Exchanger

A heat exchanger according to an embodiment of the present invention includes: a hollow type heat recovery member; a first outer cylindrical member; an inner cylindrical member; an upstream cylindrical member; a cylindrical connecting member; and a downstream cylindrical member.

Figure 10:
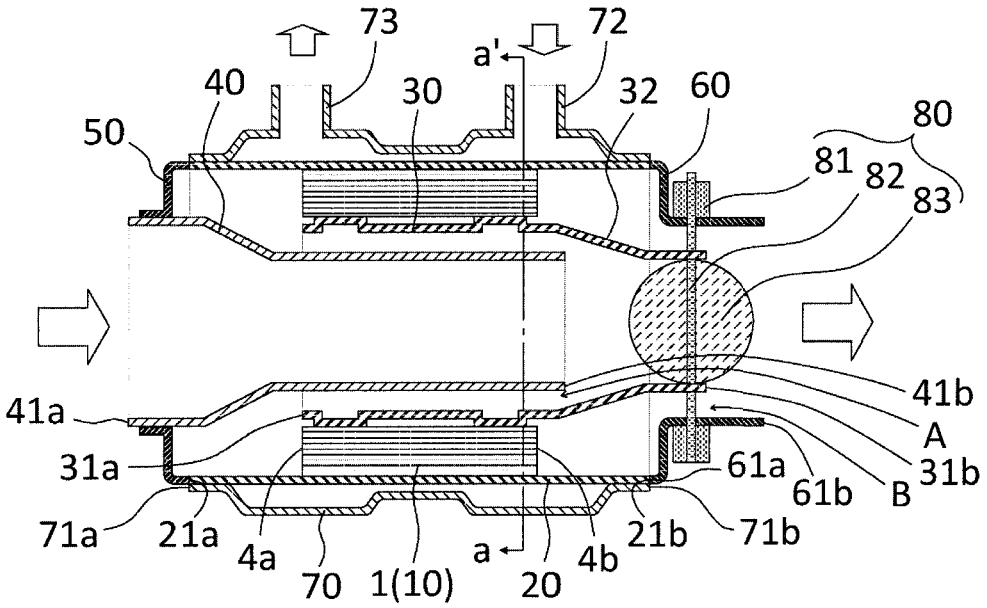
FIG. 10 is a cross-sectional view of a heat exchanger according to an embodiment of the present invention, which is parallel to a flow direction of a first fluid.
Figure 11:
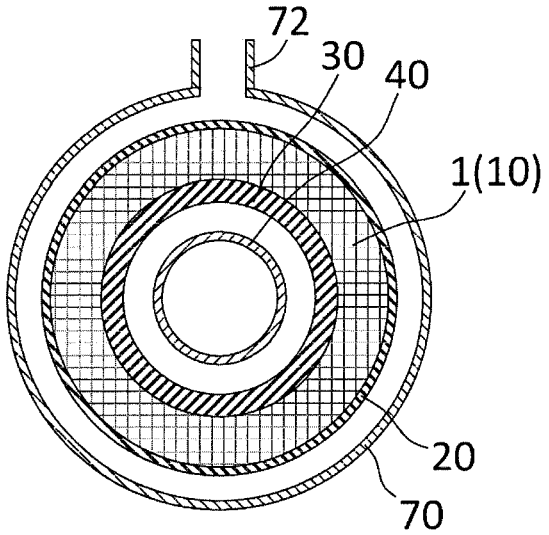
FIG. 11 is a cross-sectional view of the heat exchanger of FIG. 10 taken along the line a-a'.

FIG. 10 is a cross-sectional view of the heat exchanger according to the embodiment of the present invention, which is parallel to the flow direction of the first fluid. FIG. 11 is a cross-sectional view of the heat exchanger of FIG. 10 taken along the line a-a'.

As shown in FIG. 10, a heat exchanger 100 according to the embodiment of the present invention includes: a heat recovery member 1 (a hollow type pillar shaped honeycomb structure 10); a first outer cylindrical member 20; an inner cylindrical member 30; an upstream cylindrical member 40; a cylindrical connecting member 50; and a downstream cylindrical member 60. Also, the heat exchanger 100 according to the embodiment of the present invention can further include a second outer cylindrical member 70 and a valve mechanism 80.

Each of the members will be described below.

<Heat Recovery Member 1>

As shown in FIG. 1, the heat recovery member 1 has an inner peripheral surface 2 and an outer peripheral surface 3 in the axial direction, and a first end face 4*a* and a second end face 4*b* in a direction orthogonal to the axial direction. The heat recovery member 1 is not particularly limited, and a hollow pillar shaped honeycomb structure 10 as shown in FIG. 2 can be used.

The details of the heat recovery member 1 have already been described above, and so the descriptions thereof will be omitted.

<First Outer Cylindrical Member 20>

The first outer cylindrical member 20 is fitted to an outer peripheral surface 3 of the heat recovery member 1. The fitting may be either directly or indirectly performed, but it may preferably be directly performed in terms of heat recovery efficiency.

The first outer cylindrical member 20 is a cylindrical member having an upstream end portion 21*a* and a downstream end portion 21*b*.

It is preferable that an axial direction of the first outer cylindrical member 20 coincides with that of the heat recovery member 1, and a central axis of the first outer cylindrical member 20 coincides with that of the heat recovery member 1. Also, a central position of the first outer cylindrical member 20 in an axial direction may coincide with that of the heat recovery member 1 in the axial direction. Further, diameters (an outer diameter and an inner diameter) of the first outer cylindrical member 20 may be uniform in the axial direction, but the diameter of at least a part (for example, both ends in the axial direction or the like) of the first outer cylinder may be increased or decreased.

Non-limiting examples of the first outer cylindrical member 20 that can be used herein include a cylindrical member fitted to the outer peripheral surface 3 of the heat recovery member 1 to cover circumferentially the outer peripheral surface 3 of the heat recovery member 1.

As used herein, the "fitted" means that the heat recovery member 1 and the first outer cylindrical member 20 are fixed in a state of being suited to each other. Therefore, the fitting of the heat recovery member 1 and the first outer cylindrical member 20 encompasses cases where the heat recovery member 1 and the first outer cylindrical member 20 are fixed to each other by a fixing method based on fitting such as clearance fitting, interference fitting and shrinkage fitting, as well as by brazing, welding, diffusion bonding, and the like.

The first outer cylindrical member 20 may preferably have an inner surface shape corresponding to the surface of the outer peripheral surface 3 of the heat recovery member 1. Since the inner surface of the first outer cylindrical member 20 is in direct contact with the outer peripheral surface 3 of the heat recovery member 1, the thermal conductivity is improved and the heat in the heat recovery member 1 can be efficiently transferred to the first outer cylindrical member 20.

In terms of improvement of the heat recovery efficiency, a higher ratio of an area of a portion circumferentially covered with the first outer cylindrical member 20 in the outer peripheral surface 3 of the heat recovery member 1 to the total area of the outer peripheral surface 3 of the heat recovery member 1 is preferable. Specifically, the area ratio is preferably 80% or more, and more preferably 90% or more, and even more preferably 100% (that is, the entire outer peripheral surface of the heat recovery member 1 is circumferentially covered with the first outer cylindrical member 20).

It should be noted that the term "the surface of the outer peripheral surface 3" as used herein refers to a surface of the heat recovery member 1, which is parallel to the flow path direction of the first fluid, and does not include surfaces (the first end face 4*a* and the second end face 4*b*) of the heat recovery member 1, which are perpendicular to the flow path direction of the first fluid.

The material of the first outer cylindrical member 20 is not particularly limited, and the same material as that of the inner cylindrical member 30 as described above can be used.

Also, the thickness of the first outer cylindrical member 20 is not particularly limited, and it may be the same as that of the inner cylindrical member 30 as described above.

<Inner Cylindrical Member 30>

The inner cylindrical member 30 is fitted so as to be brought into surface contact with a portion of the inner peripheral surface 2 of the heat recovery member 1 other than both end portions (4*a*, 4*b*) in the axial direction. The fitting may be direct or indirect via other member (e.g., the buffering material 300 as described above).

The inner cylindrical member 30 is a cylindrical member having an upstream end portion 31*a* and a downstream end portion 31*b*.

The inner cylindrical member 30 can be brought into surface contact with the inner peripheral surface 2 of the heat recovery member 1 at two or more positions. FIG. 10 shows, as an example, the case where the inner cylindrical member 30 is brought into surface contact with the inner peripheral surface 2 of the heat recovery member 1 at two positions. The upper limit of the number of contact positions is not particularly limited, but it may be appropriately set according to the length of the heat recovery member 1 in the axial direction, and for example, the number of contact positions is five. By thus bringing the inner cylindrical member 30 into surface contact with the heat recovery member 1, the seal efficiency between the heat recovery member 1 and the inner cylindrical member 30 is stably ensured.

The inner cylindrical member 30 can be brought into surface contact with the first end face 4*a* and/or the second end face 4*b* of the heat recovery member 1. For example, as shown in FIG. 4, the inner cylindrical member 30 can be brought into surface contact with the second end face 4*b* (in particular, the outer peripheral portion of the second end face 4*b*) of the heat recovery member 1. Further, as shown in FIG. 5, the inner cylindrical member 30 can be brought into surface contact with the first end face 4*a* (in particular, the outer peripheral portion of the first end face 4*a*) of the heat recovery member 1. Furthermore, although not shown, the inner cylindrical member 30 can be brought into surface contact with both the first end face 4*a* and the second end face 4*b* of the heat recovery member 1. By thus bringing the inner cylindrical member 30 into surface contact with the heat recovery member 1, the seal efficiency between the heat recovery member 1 and the inner cylindrical member 30 is stably ensured.

The buffering material 300 may be arranged between the heat recovery member 1 and the inner cylindrical member 30 as shown in FIG. 9. By providing the buffering material 300, the heat recovery member 1 can be prevented from being damaged. As the buffering material 300, the material described above can be used.

The buffering material 300 can be arranged only at a portion where the heat recovery member 1 and the inner cylindrical member 30 are in surface contact. In this case, the heat recovery member 1 and the inner cylindrical member 30 are in indirect surface contact with each other via the buffer material 300. However, the buffering material 300 may be arranged not only at the portion where the heat recovery member 1 and the inner cylindrical member 30 are in surface contact, but also at a portion where the heat recovery member 1 and the inner cylindrical member 30 are not in surface contact.

The inner cylindrical member 30 preferably has a tapered portion 32 whose diameter is reduced from the position of the second end face 4*b* of the heat recovery member 1 to the downstream end portion 31*b*. The providing of such a tapered portion 32 can reduce a difference between the inner diameter of the downstream end portion 31*b* of the inner cylindrical member 30 and the inner diameter of the downstream end portion 41*b* of the upstream cylindrical member 40.

In this case, when heat recovery is suppressed (when the on-off valve 83 is opened), it can achieve the equivalent flow rate of the first fluid in the vicinity of the downstream end portion 41*b* of the upstream cylindrical member 40 (in the vicinity of the heat recovery path inlet A when promoting the heat recovery) to that of the first fluid in the vicinity of the downstream end portion 31*b* of the inner cylindrical member 30 (in the vicinity of the heat recovery path outlet B when promoting the heat recovery), thus decreasing a difference between pressures in the vicinity of the downstream end portion 41*b* of the upstream cylindrical member 40 and in the vicinity of the downstream end portion 31*b* of the inner cylindrical member 30. As a result, the backward flow phenomenon of the first fluid flowing from the heat recovery path outlet B to the heat recovery path inlet A can be suppressed, so that the heat insulation performance can be improved.

The tapered portion 32 has an inclination angle of the inner cylindrical member 30 relative to the axial direction of, preferably 45° or less, and more preferably 42° or less, and still more preferably 40° or less. The controlling of the inclination angle to such an angle can suppress the flow of the first fluid passing between the inner cylindrical member 30 and the upstream cylindrical member 40 to enter the heat recovery member 1, when heat recovery is suppressed (when the on-off valve 83 is opened), so that the heat insulation performance can be improved.

In addition, the lower limit of the inclination angle of the tapered portion 32 is not particularly limited, but it may generally be 10°, and preferably 15°, in terms of provide the compact heat exchanger 100.

It is preferable that the upstream end portion 31*a* of the inner cylindrical member 30 is arranged at substantially the same position as the first end face 4*a* of the heat recovery member 1. Such a structure can shorten the flow path for the first fluid passing between the inner cylindrical member 30 and the upstream cylindrical member 40 to enter the heat recovery member 1, when heat recovery is promoted (when the on-off valve 83 is closed), so that the heat recovery performance can be improved.

As used herein, the "substantially the same position as the first end face 4*a* of the heat recovery member 1" is a concept including not only the same position as the first end face 4*a* but also a position displaced by about ±10 mm from the first end face 4*a* of the heat recovery member 1 in the axial direction of the heat recovery member 1.

It should be noted that since other features of the inner cylindrical member 30 have already been described above, descriptions thereof will be omitted.

<Upstream Cylindrical Member 40>

The upstream cylindrical member 40 has a portion arranged on a radially inner side of the inner cylindrical member 30 at a distance so as to form a flow path for the first fluid.

The upstream cylindrical member 40 is a cylindrical member having an upstream end portion 41*a* and a downstream end portion 41*b*.

It is preferable that an axial direction of the upstream cylindrical member 40 coincides with that of the heat recovery member 1, and a central axis of the upstream cylindrical member 40 coincides with that of the heat recovery member 1.

In the upstream cylindrical member 40, the downstream end portion 41*b* preferably extends on a downstream side of the position of the second end face 4*b* of the heat recovery member 1. Such a structure can shorten the distance between the vicinity of the downstream end portion 41*b* of the upstream cylindrical member 40 (the vicinity of the heat recovery path inlet A when promoting heat recovery) and the vicinity of the downstream end portion 31*b* of the inner cylindrical member 30 (the vicinity of the heat recovery path outlet B when promoting heat recovery), so that the pressure difference between both is decreased when heat recovery is suppressed (when the on-off valve 83 is opened). As a result, the backward flow phenomenon of the first fluid flowing from the heat recovery path outlet B to the heat recovery path inlet A can be suppressed, so that the heat insulation performance can be improved.

The structure of the upstream cylindrical member 40 on the upstream end portion 41*a* side is not particularly limited, but it may be adjusted as needed, depending on the shape of other component (e.g., piping) to which the upstream end portion 41*a* of the upstream cylindrical member 40 is connected. For example, when the diameter of the other component is larger than that of the upstream end portion 41*a*, the diameter of the upstream end portion 41*a* may be increased as shown in FIG. 10.

A method of fixing the upstream cylindrical member 40 is not particularly limited, but the upstream cylindrical member 40 may be fixed to the first cylindrical member 20 or the like via a cylindrical connecting member 50 described below. The fixing method includes, but not limited to, the same method as that of the first outer cylindrical member 20 as described above.

A material of the upstream cylindrical member 40 is not particularly limited, and it may employ the same material as that of the inner cylindrical member 30 as described above.

Also, the thickness of the upstream cylindrical member 40 is not particularly limited, and it can be the same thickness as that of the inner cylindrical member 30 as described above.

<Cylindrical Connecting Member 50>

The cylindrical connecting member 50 is a cylindrical member that connects the upstream end portion 21*a* of the first outer cylindrical member 20 to the upstream side of the upstream cylindrical member 40 so as to form the flow path for the first fluid. The connection may be direct or indirect. In the case of indirect connection, for example, an upstream end portion 71*a* of a second outer cylindrical member 70, which will be described later, or the like may be arranged between the upstream end portion 21*a* of the first outer cylindrical member 20 and the upstream side of the upstream cylindrical member 40.

It is preferable that an axial direction of the cylindrical connecting member 50 coincides with that of the heat recovery member 1, and a central axis of the cylindrical connecting member 50 coincides with that of the heat recovery member 1.

The shape of the cylindrical connecting member 50 is not particularly limited, but it may have a curved structure. Such a structure can provide smooth flowing of the first fluid entering through the heat recovery path inlet A to flows to the heat recovery member 1 during proportion of heat recovery (when the on-off valve 83 is opened), so that the pressure loss can be reduced.

A material of the cylindrical connecting member 50 is not particularly limited, and it can employ the same material as that of the inner cylindrical member 30 as described above.

Also, the thickness of the cylindrical connecting member 50 is not particularly limited, and it can be the same thickness as that of the inner cylindrical member 30 as described above.

<Downstream Cylindrical Member 60>

The downstream cylindrical member 60 has a portion which is connected to the downstream end portion 21*b* of the first outer cylindrical member 20 and which is arranged on a radially outer side of the inner cylindrical member 30 at a distance so as to form the flow phat for the first fluid. The connection may be direct or indirect. In the case of indirect connection, for example, a downstream end portion 71*b* of a second outer cylindrical member 70 which will be described below, or the like, may be arranged between the downstream cylindrical member 60 and the downstream end portion 21*b* of the first outer cylindrical member 20.

The downstream cylindrical member 60 is a cylindrical member having an upstream end portion 61*a* and a downstream end portion 61*b*.

It is preferable that an axial direction of the downstream cylindrical member 60 coincides with that of the heat recovery member 1, and a central axis of the downstream cylindrical member 60 coincides with that of the heat recovery member 1.

Diameters (outer diameter and inner diameter) of the downstream cylindrical member 60 may be uniform in the axial direction, but at least a part of the diameters may be decreased or increased.

A material of the downstream cylindrical member 60 is not particularly limited, and it can employ the same material as that of the inner cylindrical member 30 as described above.

Also, the thickness of the downstream cylindrical member 60 is not particularly limited, and it can be the same thickness as that of the inner cylindrical member 30 as described above.

<Second Outer Cylindrical Member 70>

The second outer cylindrical member 70 is arranged on a radially outer side of the first outer cylindrical member 20 at a distance so as to form a flow path for a second fluid.

The second outer cylindrical member 70 is a cylindrical member having an upstream end portion 71*a* and a downstream end portion 71*b*.

It is preferable that an axial direction of the outer cylindrical member 70 coincides with that of the heat recovery member 1, and a central axis of the second outer cylindrical member 70 coincides with that of the heat recovery member 1.

The upstream end portion 71*a* of the second outer cylindrical member 70 preferably extends beyond the position of the first end face 4*a* of the heat recovery member 1 to the upstream side. Such a structure can allow a heat recovery efficiency to be improved.

The second outer cylindrical member 70 is preferably connected to both a feed pipe 72 for feeding the second fluid to a region between the second outer cylindrical member 70 and the first outer cylindrical member 20, and a discharge pipe 73 for discharging the second fluid from a region between the second outer cylindrical member 70 and the first outer cylindrical member 20. The feed pipe 72 and the discharge pipe 73 are preferably provided at positions corresponding to both axial ends of the heat recovery member 1, respectively.

The feed pipe 72 and the discharge pipe 73 may extend in the same direction, or may extend in different directions.

The second outer cylindrical member 70 is preferably arranged such that inner peripheral surfaces of the upstream end portion 71*a* and the downstream end portion 71*b* are in direct or indirect contact with the outer peripheral surface of the first outer cylindrical member 20.

A method of fixing the inner peripheral surfaces of the upstream end portion 71*a* and the downstream end portion 71*b* of the second outer cylindrical member 70 to the outer peripheral surface of the first outer cylindrical member 20 that can be used herein includes, but not limited to, fitting such as clearance fitting, interference fitting and shrinkage fitting, as well as brazing, welding, diffusion bonding, and the like.

Diameters (outer diameter and inner diameter) of the second outer cylindrical member 70 may be uniform in the axial direction, but the diameter of at least a part (for example, a central portion in the axial direction, both ends in the axial direction, or the like) of the second outer cylindrical member 70 may be decreased or increased. For example, by decreasing the diameter of the central portion in the axial direction of the second outer cylindrical member 70, the second fluid can spread throughout the outer peripheral direction of the first outer cylindrical member 20 in the second outer cylindrical member 70 on the feed pipe 72 and discharge pipe 73 sides. Therefore, an amount of the second fluid that does not contribute to the heat exchange at the central portion in the axial direction is reduced, so that the heat exchange efficiency can be improved.

A material of the second outer cylindrical member 70 is not particularly limited, and it can employ the same material as that of the inner cylindrical member 30 as described above.

Also, the thickness of the second outer cylindrical member 70 is not particularly limited, and it can the same thickness as that of the inner cylindrical member 30 as described above.

<Valve Mechanism 80>

The valve mechanism 80 has an on-off valve 83 arranged on the downstream end portion 31*b* side of the inner cylindrical member 30. The on-off valve 83 is rotatably supported by a bearing 81 arranged on a radially outer side of the downstream cylindrical member 60, and is fixed to a shaft 82 arranged so as to penetrate the downstream cylindrical member 60 and the inner cylindrical member 30.

By arranging the bearing 81 on the radially outer side of the downstream cylindrical member 60, the bearing 81 will not be exposed to the exhaust gas at an elevated temperature, so that the bearing 81 can be prevented from being degraded. As a result, the on-off valve 83 can be stably closed when heat recovery is promoted, and the heat recovery performance can be improved. Further, since the bearing 81 is not present in the flow path for the first fluid, the pressure loss can be reduced. Furthermore, since the bearing 81 is arranged on the radially outer side of the downstream cylindrical member 60, there is no need for ensuring a space for arranging the bearing 81 between the radially outer side of the inner cylindrical member 30 and the downstream cylindrical member 60, and the space can be reduced, so that the size and weight of the heat exchanger 100 can be decreased.

The valve mechanism 80 is not particularly limited as long as it has the above structure. Since the structure of the valve mechanism 80 itself is known in the art, the known valve mechanism can be applied to the heat exchanger 100 according to the embodiment of the present invention. The shape of the on-off valve 83 may be appropriately selected depending on the shape of the inner cylindrical member 30 in which the on-off valve 83 is to be provided.

The valve mechanism 80 can drive (rotate) the shaft 82 by an actuator (not shown). The on-off valve 83 can be opened and closed by rotating the on-off valve 83 together with the shaft 82.

The on-off valve 83 is configured so that the flow of the first fluid inside the inner cylindrical member 30 can be controlled. More particularly, by closing the on-off valve 83 during promotion of heat recovery, the first fluid can be circulated from the heat recovery path inlet A to the pillar shaped honeycomb structure 10. Further, by opening the on-off valve 83 during suppression of heat recovery, the first fluid can be circulated from the downstream end portion 31*b* side of the inner cylindrical member 30 to the downstream cylindrical member 60 to discharge the first fluid to the outside of the heat exchanger 100.

<First Fluid and Second Fluid>

The first fluid and the second fluid used in the heat exchanger 100 are not particularly limited, and various liquids and gases can be used. For example, when the heat exchanger 100 is mounted on a motor vehicle, an exhaust gas can be used as the first fluid, and water or antifreeze (LLC defined by JIS K2234: 2006) can be used as the second fluid. Further, the first fluid can be a fluid having a temperature higher than that of the second fluid.

<Method for Producing Heat Exchanger 100>

The heat exchanger 100 can be produced in accordance with a method known in the art. For example, when the hollow type pillar shaped honeycomb structure 10 is used as the heat recovery member 1, the heat exchanger 100 can be produced in accordance with the method as described below.

First, a green body containing ceramic powder is extruded into a desired shape to prepare a honeycomb formed body. At this time, the shape and density of the cells 14, and lengths and thicknesses of the partition wall 15, the inner peripheral wall 11 and the outer peripheral wall 12, and the like, can be controlled by selecting dies and jigs in appropriate forms. The material of the honeycomb formed body that can be used herein includes the ceramics as described above. For example, when producing a honeycomb formed body containing the Si-impregnated SiC composite as a main component, a binder and water or an organic solvent are added to a predetermined amount of SiC powder, and the resulting mixture is kneaded to form a green body, which can be then formed into a honeycomb formed body having a desired shape. The resulting honeycomb formed body can be then dried, and the honeycomb formed body can be impregnated with metal Si and fired under in an inert gas reduced pressure or vacuum to obtain a hollow pillar shaped honeycomb structure 10 having the cells 14 defined by the partition wall 15.

The hollow pillar shaped honeycomb structure 10 is then inserted into the first outer cylindrical member 20, and the first outer cylindrical member 20 is fitted to the surface of the outer peripheral wall 12 of the hollow pillar shaped honeycomb structure 10. The fitting method at this time is not particularly limited, but the plastic working such as the bulging is preferable. The use of the plastic working eliminates needs to form the positioned sealing portions in the inner cylindrical member 30 in advance or to weld the sealing members to the inner cylindrical member 30, so that the seal efficiency between the hollow type pillar shaped honeycomb structure 10 and the inner cylindrical member 30 can be improved. Subsequently, the inner cylindrical member 30 is inserted into the hollow region of the hollow pillar shaped honeycomb structure 10 and the inner cylindrical member 30 is fitted to the surface of the inner peripheral wall 11 of the hollow pillar shaped honeycomb structure 10. The second outer cylindrical member 70 is then arranged on and fixed to the radially outer side of the first outer cylindrical member 20. The feed pipe 72 and the discharge pipe 73 may be previously fixed to the second outer cylindrical member 70, but they may be fixed to the second outer cylindrical member 70 at an appropriate stage. Next, the upstream cylindrical member 40 is arranged on the radially inner side of the inner cylindrical member 30, and the upstream end portion 21*a* of the first outer cylindrical member 20 and the upstream side of the upstream cylindrical member 40 are connected to each other via the cylindrical connecting member 50. The downstream cylindrical member 60 is then disposed at and connected to the downstream end portion 21*b* of the first outer cylindrical member 20. The valve mechanism 80 is then attached to the downstream end portion 31*b* side of the inner cylindrical member 30.

In addition, the arranging and fixing (fitting) orders of the respective members are not limited to the above orders, and they may be changed as needed within a range in which the members can be produced.

DESCRIPTION OF REFERENCE NUMERALS

1 heat recovery member
2 inner peripheral surface
3 outer peripheral surface
4*a* first end face
4*b* second end face
5 hollow portion
10 pillar shaped honeycomb structure
11 inner peripheral wall
12 outer peripheral wall
13*a* first end face
13*b* second end face
14 cell
15 partition wall
20 first outer cylindrical member
21*a* upstream end portion
21*b* downstream end portion
30 inner cylindrical member
31*a* upstream end portion
31*b* downstream end portion

32 tapered portion
35 sealing portion
40 upstream cylindrical member
41*a* upstream end portion
41*b* downstream end portion
50 cylindrical connecting member
60 downstream cylindrical member
61*a* upstream end portion
61*b* downstream end portion
70 second outer cylindrical member
71*a* upstream end portion
71*b* downstream end portion
72 feed pipe
73 discharge pipe
80 valve mechanism
81 bearing
82 shaft
83 on-off valve
100 heat exchanger
200 mold
300 buffering member

The invention claimed is:

1. A method for producing a heat conductive member, the method comprising the steps of:

preparing a hollow type heat recovery member having: an inner peripheral surface and an outer peripheral surface in an axial direction; and a first end face and a second end face in a direction orthogonal to the axial direction;

inserting an inner cylindrical member into a hollow portion formed in an inner region of the inner peripheral surface; and subjecting the inner cylindrical member to plastic working, and fitting at least a part of the inner cylindrical member to at least a part of one or more selected from the inner peripheral surface, the first end face, and the second end face of the heat recovery member.

2. The method for producing a heat conductive member according to claim 1, wherein the plastic working is performed so that the inner cylindrical member is brought into surface contact with the first end face and/or the second end face.

3. The method for producing a heat conductive member according to claim 1, wherein the plastic working is performed so that the inner cylindrical member is brought into surface contact with a portion other than both end portions in the axial direction of the inner peripheral surface.

4. The method for producing a heat conductive member according to claim 1, wherein the plastic working is performed so that the inner cylindrical member is brought into surface contact with the entire inner peripheral surface.

5. The method for producing a heat conductive member according to claim 1, wherein the plastic working is performed so that the inner cylindrical member is brought into surface contact with the inner peripheral surface at two or more positions.

6. The method for producing a heat conductive member according to claim 1, wherein the inner cylindrical member has a difference between a diameter of a portion of the heat recovery member inserted into the hollow portion and a diameter of the hollow portion of the heat recovery member of 1 mm to 10 mm.

7. The method for producing a heat conductive member according to claim 1, further comprising a step of previously arranging a buffering material on the outer peripheral surface of the inner cylindrical member before inserting the inner cylindrical member into the hollow portion of the heat recovery member.

8. The method for producing a heat conductive member according to claim 1, wherein the heat recovery member is a hollow type pillar shaped honeycomb structure having an inner peripheral wall, an outer peripheral wall and a partition wall disposed between the inner peripheral wall and the outer peripheral wall, the partition wall defining a plurality of cells, each of the cells extending from a first end face to a second end face to form a flow path for a first fluid.

* * * * *